US006387028B1

(12) United States Patent
Nishio et al.

(10) Patent No.: US 6,387,028 B1
(45) Date of Patent: May 14, 2002

(54) PACKAGING MACHINE

(75) Inventors: Yoji Nishio; Kazumasa Nishiuchi; Michio Ueda, all of Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/536,989

(22) Filed: Mar. 29, 2000

(30) Foreign Application Priority Data

Mar. 31, 1999 (JP) ..... 11-092447

(51) Int. Cl.[7] ..... B31B 1/28
(52) U.S. Cl. ..... 493/165; 493/452
(58) Field of Search ..... 493/165, 397, 493/405, 452; 53/565

(56) References Cited

U.S. PATENT DOCUMENTS 3,579,958 A * 5/1971 Hentges
4,589,862 A 5/1986 Murrah ..... 493/183
4,761,156 A * 8/1988 Bachner et al.
5,234,398 A * 8/1993 Larsen
5,369,933 A * 12/1994 Walstadt
5,538,491 A * 7/1996 Owen et al.

FOREIGN PATENT DOCUMENTS

EP 0 698 555 A1 2/1986

OTHER PUBLICATIONS

Abstract of 00200561.9 (XS 0020056110 MA).

* cited by examiner

*Primary Examiner*—Eugene Kim
(74) *Attorney, Agent, or Firm*—Armstrong, Westerman & Hattori, LLP

(57) ABSTRACT

A packaging machine comprises a movable body having mandrels and intermittently drivable so as to stop each of the mandrels at a process station while carrying containers as fitted around the respective mandrels with a bottom forming portion of each container projecting outward from the mandrel, and a bottom breaker for forming folds in a bottom forming end portion of the container fitted around the mandrel as halted at the process station so as to render the end portion foldable flat. The bottom breaker has first folding means for initially folding the second and fourth bottom panels in two into triangles, and second folding means for subsequently folding first and third bottom panels. The second folding means has an upstream arm movable into pressing contact with the first bottom panel, and a downstream arm movable into pressing contact with the third bottom panel. The downstream arm is provided with a pressure plate at a portion thereof to be contacted with the third bottom panel.

7 Claims, 6 Drawing Sheets

42
21
62
61
42
23
11
61
63
36
31

42
62
23
11
63
42
21
31
36

42
61
21
62
23
42
11
61
63
36
31

42
61
62
42
21
11
61
63
23
36
31

PACKAGING MACHINE

BACKGROUND OF THE INVENTION

The present invention relates to packaging machines for containers such as cartons for containing milk, and more particularly to packaging machines including a bottom breaker.

Packaging machines of the type mentioned include those already known which comprise, as disclosed in JP-Y No. 6-46669, a movable body having mandrels and intermittently drivable so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, and a bottom breaker for forming folds in a bottom forming end portion of the container fitted around the mandrel as halted at the process station so as to render the end portion foldable flat, the bottom breaker having first folding means and second folding means, the first folding means being operable to fold the second and fourth bottom panels in two into triangles first, the second folding means being operable to fold first and third bottom panels subsequent to the second and fourth bottom panels, the second folding means having a folding member movable axially of the mandrel as halted at the process station, the folding member being movable into pressing contact with the first bottom panel and the third bottom panel for folding.

With the packaging machine described, the folding member comes into rubbing contact with the first bottom panel and the third bottom panel for folding, consequently marring these bottom panels to result in an impaired commercial value, producing polyethylene fragments as removed from the container surface or releasing paper particles, hence insanitation. Especially when the container is moved with the mandrel after folding, the first and second bottom panels are strongly rubbed against the folding member.

Furthermore, the folding member is reciprocatingly moved linearly in addition to the frictional contact with the bottom panels, so that it has been difficult to operate the machine at a higher speed.

The folding angle of the first and third bottom panels is dependent on the shape of the portion of the folding member to be brought into contact with these panels. It is therefore not easy to adjust the folding angle even if an attempt is made to increase the folding angle of the first and third bottom panels. Different materials used for containers require the adjustment of the folding angle.

Further because the first and third bottom panels are pressed in the same direction at the same time by the folding member, the outer edge portion of the first bottom panel is not always smoothly inserted by folding between the outer edge portion of the third bottom panel and the triangular portions of the second and fourth bottom panels.

SUMMARY OF THE INVENTION

An object of the present invention is to overcome the foregoing problems and provide a packaging machine which is unlikely to impair the commercial value of the product and which is capable of folding the bottom forming portions of containers to the desired finished shape and adapted for a high-speed operation.

The present invention provides a packaging machine which comprises a movable body having mandrels and intermittently drivable so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, and a bottom breaker for forming folds in a bottom forming end portion of the container fitted around the mandrel as halted at the process station so as to render the end portion foldable flat, the bottom breaker having first folding means and second folding means, the first folding means being operable to fold the second and fourth bottom panels in two into triangles first, the second folding means being operable to fold first and third bottom panels subsequent to the second and fourth bottom panels. The packaging machine is characterized in that the second folding means has an upstream arm and a downstream arm each pivotally movable toward and away from the other about an axis extending transversely of the direction of movement of the mandrel, the upstream arm being movable into pressing contact with the first bottom panel for folding, the downstream arm being movable into pressing contact with the third bottom panel for folding, the downstream arm being provided at a portion thereof to be contacted with the third bottom panel with a pressure roller having an axis of rotation extending transversely of the direction of movement of the mandrel.

With the packaging machine of the present invention, the second folding means has an upstream arm and a downstream arm each pivotally movable toward and away from the other about an axis extending transversely of the direction of movement of the mandrel. For folding, the upstream arm is moved into pressing contact with the first bottom panel, and the downstream arm is moved into pressing contact with the third bottom panel. The downstream arm is provided, at a portion thereof to be contacted with the third bottom panel, with a pressure roller having an axis of rotation extending transversely of the direction of movement of the mandrel. The pressure roller is therefore unlikely to mar the third bottom panel and to impair the commercial value of the container. Furthermore, the machine produces or releases none of extraneous substances such as polyethylene fragments.

Since the upstream arm and the downstream arm act on the first and third bottom panels, respectively, from a direction approximately orthogonal thereto, these panels can be folded smoothly without forcible folding.

When the upstream arm is provided at a portion thereof to be contacted with the first bottom panel with a pressure roller having an axis of rotation extending transversely of the direction of movement of the mandrel, the first bottom panel, in addition to the third bottom panel, is also unlikely to become marred and is effectively prevented from releasing extraneous matter.

When the upstream arm and the downstream arm are mounted respectively on a pair of pivots extending in parallel to each other and adjustable in the angle of pivotal movement, the folding angle of the first and third bottom panels can be adjusted easily by adjusting the ranges of pivotal movement of these arms.

If the upstream arm is made longer than the downstream arm, the first bottom panel and the third bottom panel can be folded at different speeds. When the first bottom panel is made foldable more rapidly than the third bottom panel, these first and third bottom panels can be folded to the desired shape reliably.

A folding rail is further disposed so as to guide the bottom forming portion of the container as fitted around the mandrel moving from the process station while folding the bottom forming portion flat by contact therewith, the mandrel being movable with the pressure roller of the downstream arm in contact with the third bottom panel, and the third bottom panel of the container as fitted around the mandrel being moved is brought into contact with the folding rail while the third bottom panel is held in contact with the pressure roller. The folding rail further folds the bottom forming portion more reliably without the likelihood of unfolding from the state as folded by the upstream and downstream arms.

When the first folding means and the second folding means are driven individually by respective actuators, the timing of folding by these folding means can be determined as desired.

Accordingly, without the likelihood of impairing the commercial value of the product, the bottom forming portions of containers can be folded to the desired finished shape by the machine of the invention which is made operable at a higher speed.

DESCRIPTION OF THE PREFERRED EMBODIMENT

An embodiment of the present invention will be described next with reference to the drawings.

In the following description, the terms "front" and "rear" refer respectively to the left-hand side and the right-hand side of FIG. 1, and the terms "left" and "right" are used for the machine as it is seen from the rear forward.

Figure 6:
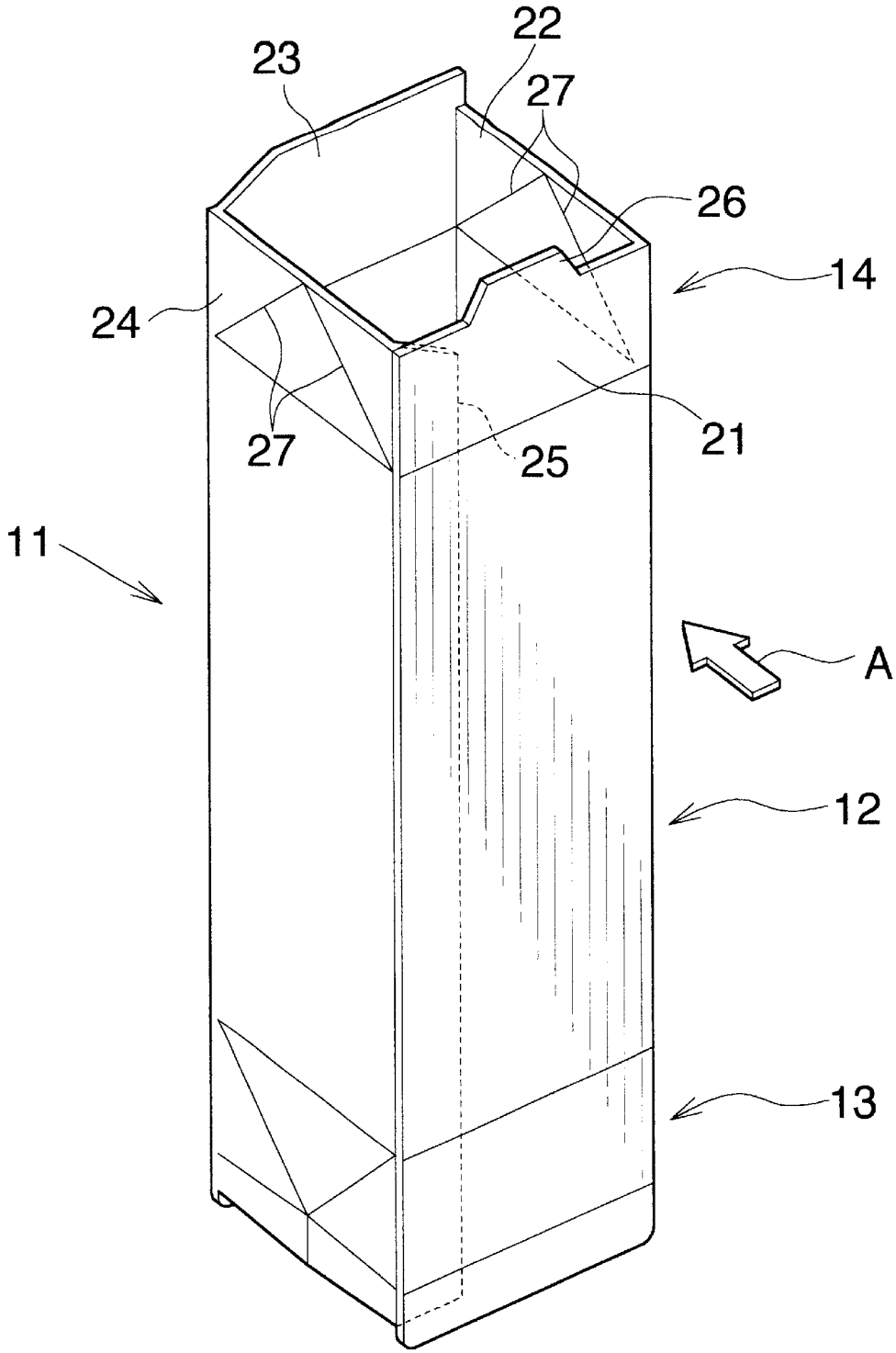
FIG. 6 is a perspective view of a container to be used for the packaging machine.

FIG. 6 shows a container 11 as turned upside down. The container 11 comprises a trunk forming portion 12 to be made into a trunk, a top forming portion 13 to be made into a top portion, and a bottom forming portion 14 to be made into a bottom portion.

The bottom forming portion 14 comprises first to fourth rectangular bottom panels 21 to 24 joined to one another endlessly, and a striplike fifth bottom panel 25 integral with a free edge of the fourth bottom panel 24 and affixed to the inner surface of the first bottom panel 21. The first bottom panel 21 is formed at the center of its upper edge with an ear 26 in the form of an upwardly projection trapezoid. The second and fourth bottom panels 22, 24 are each formed with an inverted V-shaped score 27.

The bottom forming portion 14 is folded in the following manner. First, the second and fourth bottom panels 22, 24 are folded inward while being folded each in two along the scores 27, and the first and third bottom panels 21, 23 are then folded over the second and fourth bottom panels 22, 24 thus folded. The ear 26 is tucked between the third bottom panel 23 and triangular portions of the second bottom panel 22 and the fourth bottom panels 24.

Figure 1:
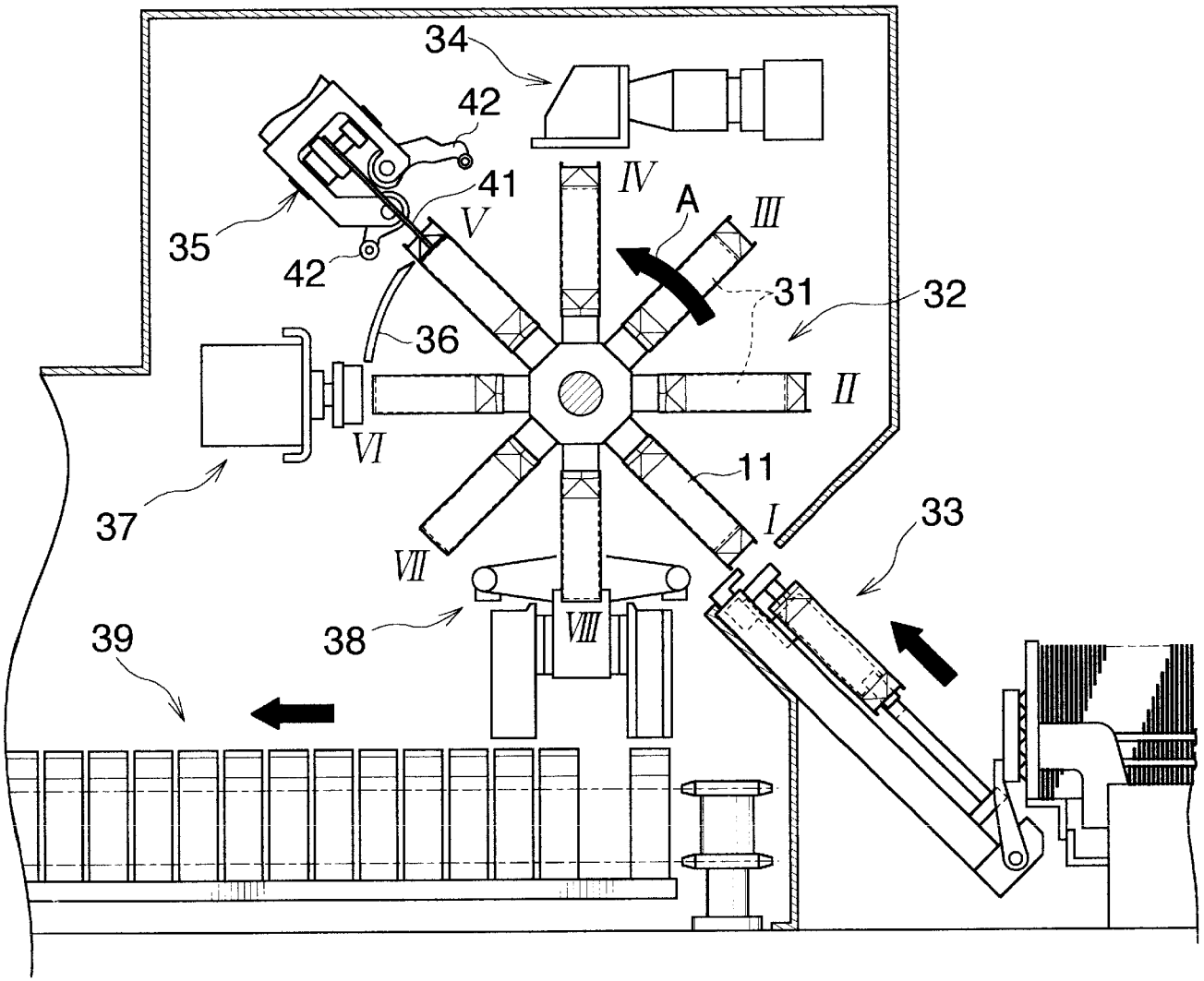
FIG. 1 is a side elevation of a packaging machine embodying the invention.

FIG. 1 shows a packaging machine which comprises an intermittently drivable rotor 32 having eight radial mandrels 31 so arranged as to rotate counterclockwise as indicated by an arrow A in FIG. 1 and successively stop at eight stations, i.e., first to eighth process stations I to VIII, a feeder 33 disposed at the first process station I, a bottom heater 34 disposed at the fourth process station IV, a bottom breaker 35 disposed at the fifth process station V, a folding rail 36 extending from the fifth process station V to the sixth process station VI, a bottom press 37 disposed at the sixth process station VI, an unloader 38 disposed at the eighth station VIII and a container conveyor 39 having the beginning of a path of transport at the eighth station VIII.

The second, third and seventh process stations II, III and VII are all idle stations. A preheater and other devices are provided at the idle stations.

The direction of rotation of the mandrel is indicated by an arrow A in FIG. 6. The container 11 is fitted around the mandrel 31 with its bottom forming portion 14 projecting therefrom and with its first to fourth bottom panels facing toward the upstream side with respect to the direction of movement of the mandrel, rightward, downstream side with respect to the direction of movement of the mandrel and leftward, respectively.

Figure 2:
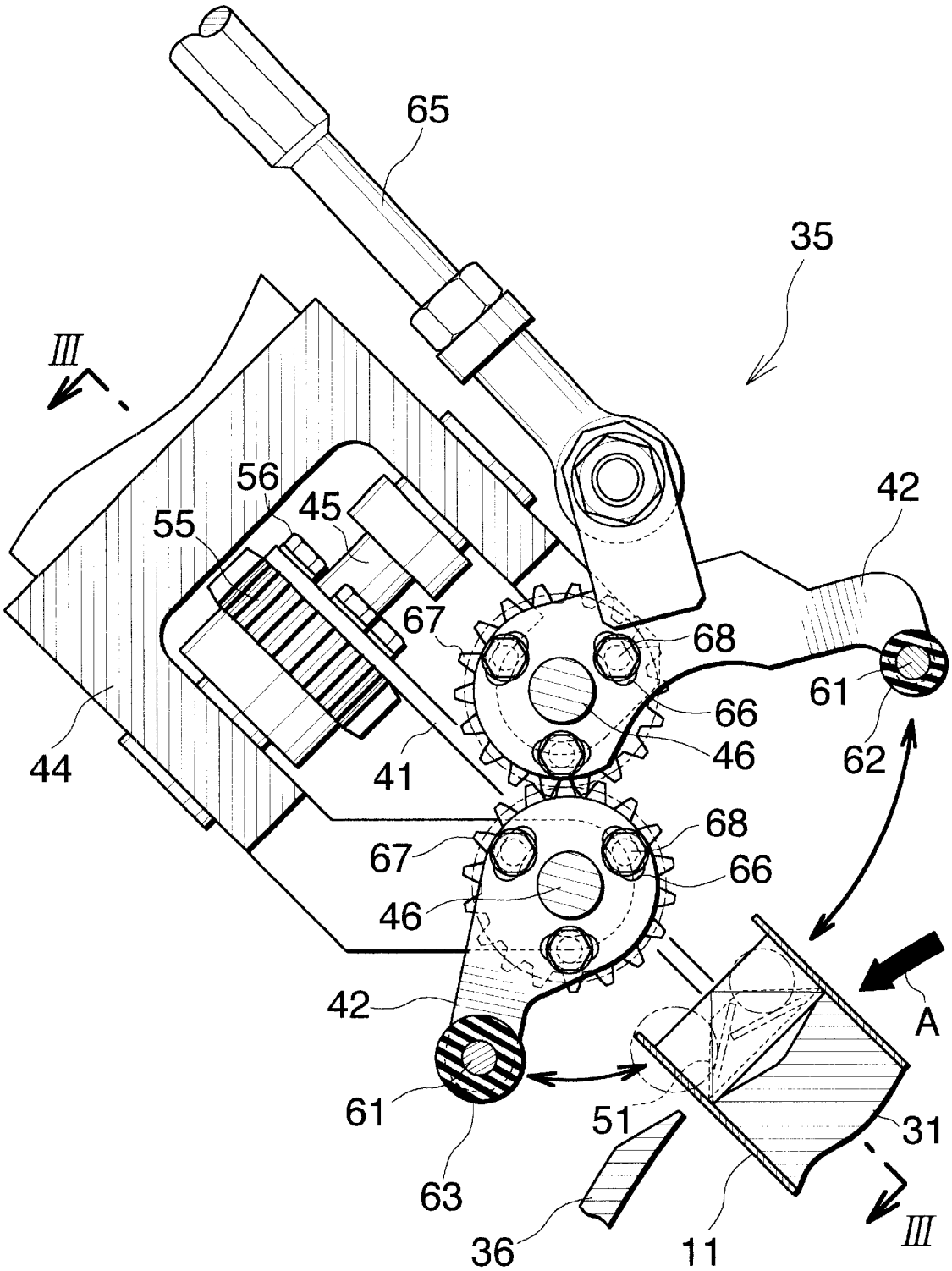
FIG. 2 is a side elevation of a bottom breaker of the packaging machine.
Figure 3:
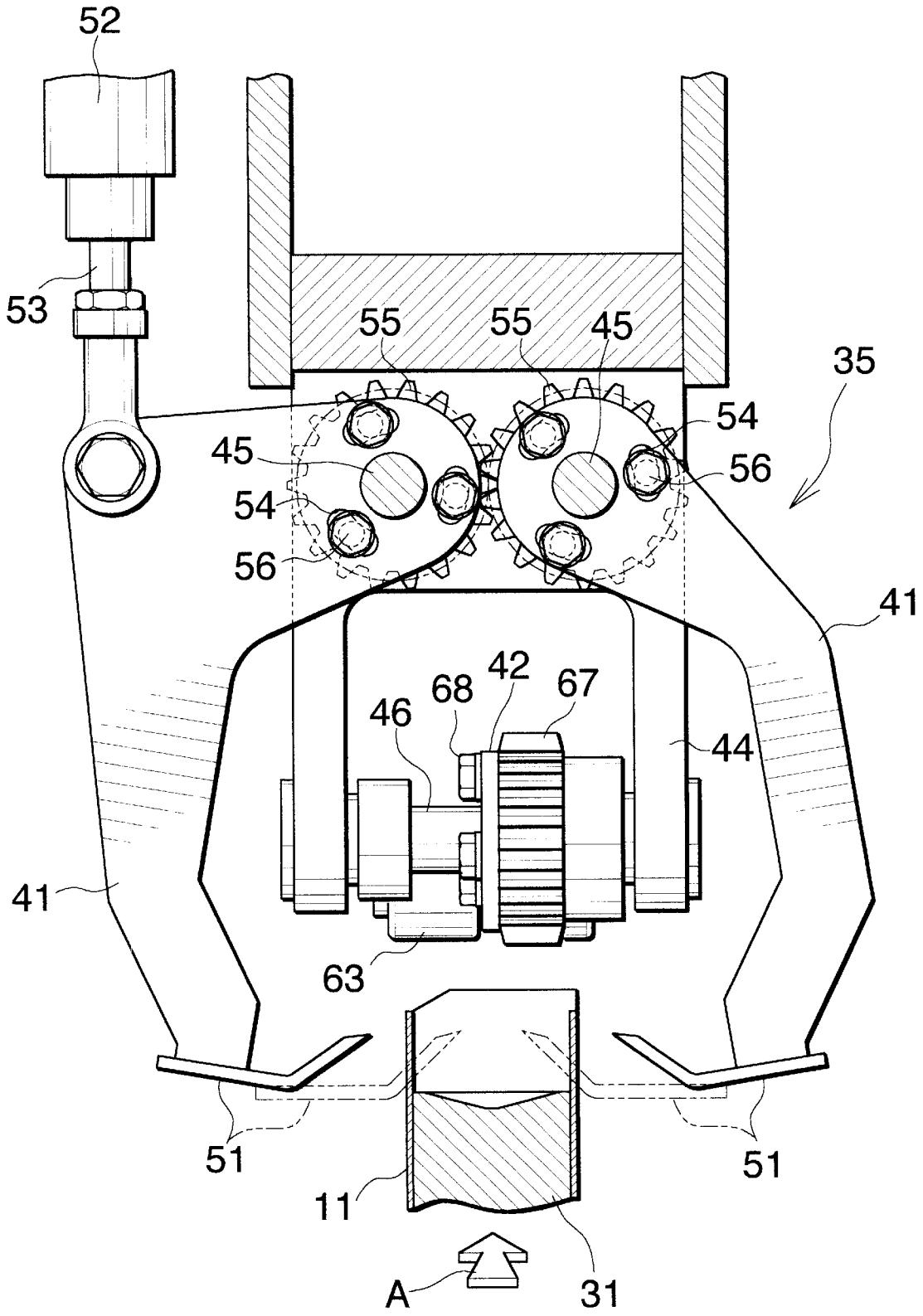
FIG. 3 is a view in section taken along the line III—III in FIG. 2.
Figure 4:
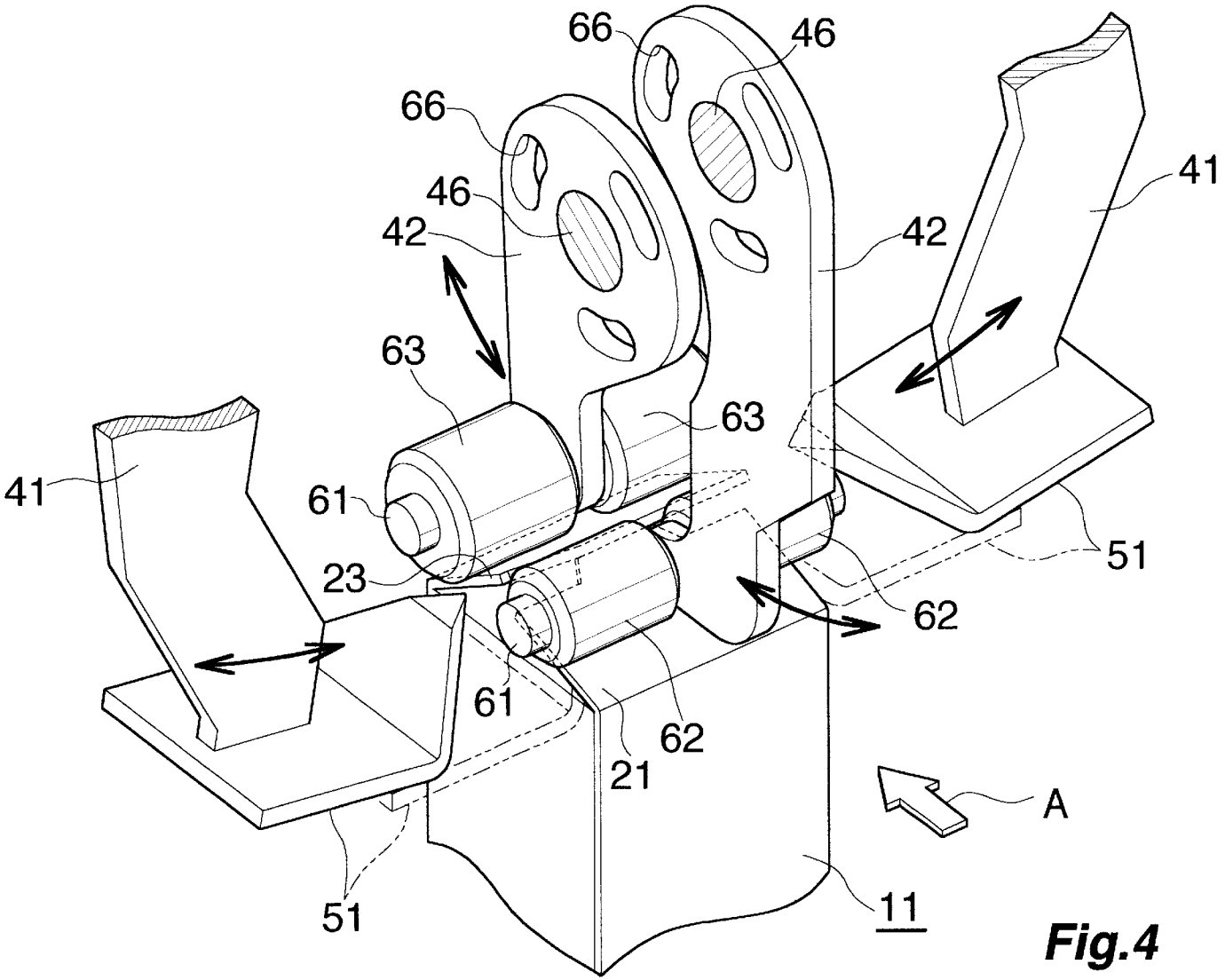
FIG. 4 is a perspective view of the bottom breaker.

As shown in detail in FIGS. 2 to 4, the bottom breaker 35 comprises a pair of first folding arms 41 to be opened and closed orthogonally of the direction of movement of the mandrel at the fifth station V, and a pair of second folding arms 42 to be opened and closed along the direction of movement of the mandrel at the fifth station V.

A yoke 44 secured to a machine frame by suitable means is provided externally of the mandrel 31 as halted at the fifth station V. Supported by the yoke 44 are a pair of first pivots 45 arranged side by side transversely of the direction of movement of the mandrel, and a pair of second pivots 46 positioned inwardly of the first pivots 45 and extending leftward or rightward across the first pivots 45. The two second pivots 46 are so arranged that the upstream pivot 46 is away from the mandrel 31, with the downstream pivot 46 positioned closer to the mandrel 31. The two first folding arms 41 extend from the respective first pivots 45 inward and each have a triangular pressure plate 51 at the inward end thereof.

A piston rod 53 of a hydraulic cylinder 52 is connected to a lengthwise intermediate portion of the first folding arm 41 at the left side.

The first pivots 45 rotatably extend through the respective first folding arms 41 each at its base portion. The arm base portion is formed with a plurality of first slots 54 arranged around the extending pivot. Fixed to the respective first pivots 45 are a pair of first gears 55 meshing with each other and adjacent to the respective base portions of the first folding arms 41. First bolts 56 are inserted through the first slot 54 and screwed into each first gear 55, causing the first gear 55 to secure the first folding arm 41 to the first pivot 45.

When operated, the hydraulic cylinder 52 pivotally moves the first folding arms 41 so as to move the pressure plates 51 toward or away from each other. When the first bolts 56 are loosened, the first folding arm 41 becomes pivotally movable relative to the first pivot 45 by an amount corresponding to the length of the slots 54. When the first bolts 56 are tightened up again after varying the angle of the first folding arm 41 with respect to the first pivot 45, the arm 41 is secured to the pivot 45 again. In this way the range of pivotal movement of each first folding arm 41 is altered.

While the two second folding arms 42 extend inward from the respective second pivots 46, the upstream arm 42 is greater than the downstream arm 42 in length. Each second folding arm 42 has a horizontal roller shaft 61 extending through the inward end thereof leftward or rightward orthogonally of the arm 42. Rotatably mounted on the roller shaft 61 of the upstream arm 42 are a pair of rollers 62 of small diameter at opposite sides of the inward end of the arm 42. The downstream arm 42 has rotatably mounted on its roller shaft 61 a pair of rollers 63 of large diameter at opposite sides of the arm inward end.

Connected to a lengthwise intermediate portion of the upstream second folding arm 42 is a retractable rod 65 to be driven by a main shaft (not shown) of the machine.

The second folding arm 42 is fixed to the second pivot 46 in the same manner as the first folding arm 41, and the fixing method will not be described repeatedly. The arm 42 is formed with second slots 66. A second gear 67 is secured to the second pivot 46. Second bolts 68 are inserted through the second slots 66 and screwed into the second gear 67.

When operated, the rod 65 pivotally moves the two second folding arm 42 so as to move the pair of rollers 62 of small diameter and the pair of rollers 63 of large diameter toward each other. The range of pivotal movement of each second folding arm 42 is adjustable in the same manner as in the case of the first folding arm 41.

A folding operation will be described next with reference to FIGS. 5(*a*) to 5(*d*).

Figures 5A, 5B, 5C, 5D:
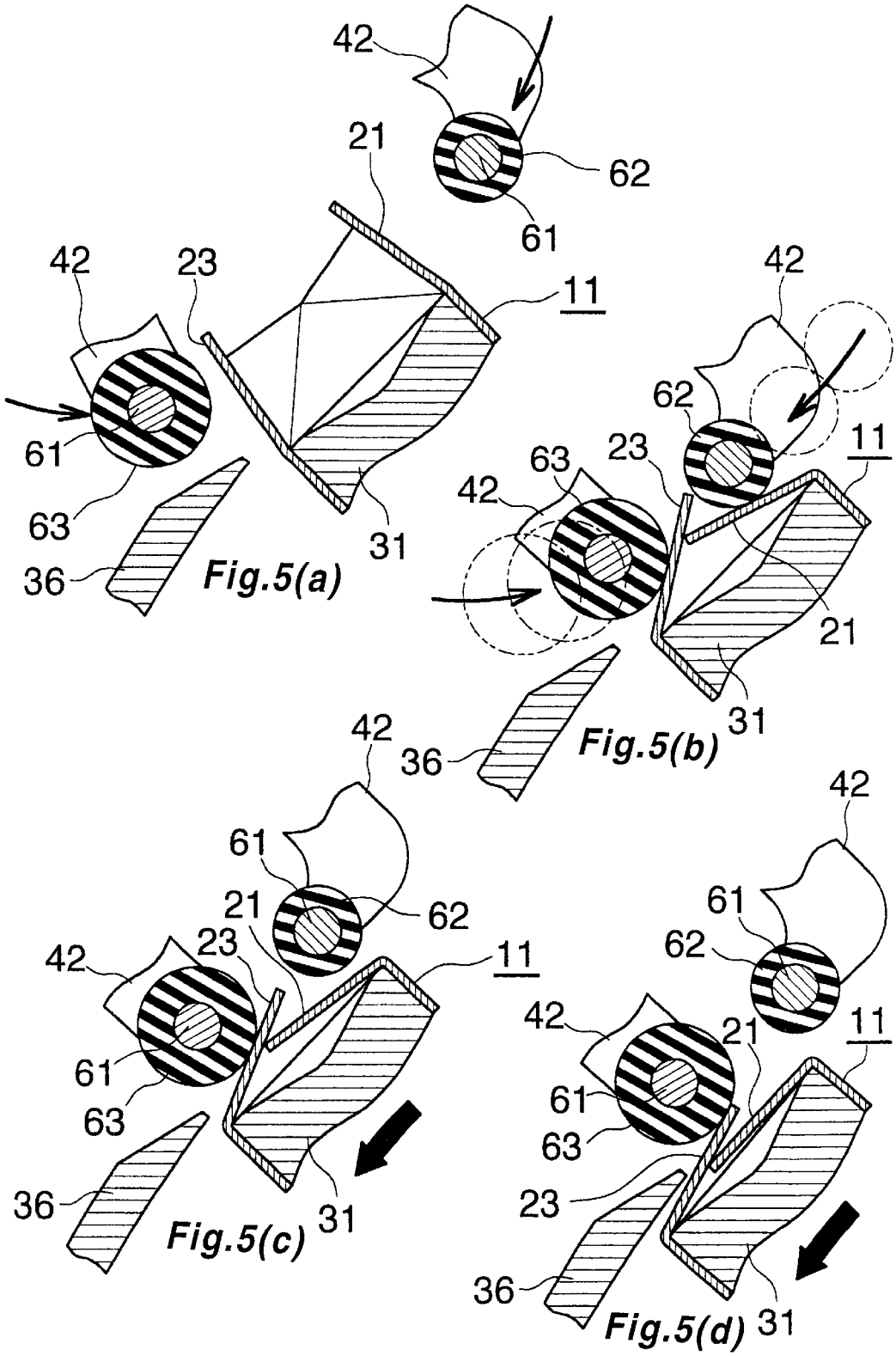
FIGS. 5(*a*)–5(*d*) are a diagram for illustrating the folding operation of the bottom breaker.

With reference to FIG. 5(*a*), each small-diameter roller 62 is away from the first bottom panel 21, whereas each large-diameter roller 63 is brought close to the third bottom panel 23. The two second folding arms 42 in this state are pivotally moved to bring the roller 62 and the roller 63 toward each other. Since the upstream arm 42 is longer than the downstream arm 42, the small-diameter roller 62 is greater than the large-diameter roller 63 in the speed and distance of movement when both rollers 62, 63 are moved toward each other. The small-diameter roller 62 is brought into pressing contact with the first bottom panel 21, and the large-diameter roller 63 into pressing contact with the third bottom panel 23, whereby the first and third bottom panels 21, 23 are gradually folded. In this case, the rollers 62, 63 contact the bottom panels 21, 23 in the vicinity of their base portions and are rolled on the bottom panels 21, 23 toward their outer ends, with the result that the bottom panels 21, 23 are smoothly folded progressively. The panels 21, 23 are smoothly folded because each of the rollers 62, 63 presses the panel 21 (23) from a direction generally orthogonal thereto.

FIG. 5(*b*) shows the small-diameter roller 62 and the large-diameter roller 63 as positioned in the closest proximity with each other, with the outer end of the first bottom panel 21 tucked under the third bottom panel 23. FIG. 5(*b*) shows the rollers 62, 63 while being moved from the state shown in FIG. 5(*a*) to the state of FIG. 5(*b*) in phantom lines. Before the rollers 62, 63 are brought to the state of FIG. 5(*b*) from the state of FIG. 5(*a*), the second bottom panel 22 and the fourth bottom panel 24 are folded by the first folding arms 41 before the first and third bottom panels 21, 23 are folded.

When the small-diameter roller 62 and the large-diameter roller 63 are brought to the position of the closest proximity, the mandrel 31 is moved as shown in FIG. 5(*c*), with the rollers 62, 63 held in this position. This movement causes the first bottom panel 21 to move under the large-diameter roller 63 while moving away from the small-diameter roller 62, whereby the first and third bottom panels 21, 23 are folded through a greater angle than in the state shown in FIG. 5(*b*).

A further movement of the mandrel 31 delivers the third bottom panel 23 from the large-diameter roller 63 to the folding rail 36, with the roller 63 still holding the panel 23 in pressing contact therewith as shown in FIG. 5(*d*).

The folding rail 36 will now be described briefly. The folding rail 36 is generally in the form of a circular arc centered about the center of rotation of the rotor 32. Precisely speaking, however, the folding rail 36 is positioned closer to the center of rotation of the rotor 32 as the rail extends from the fifth process station V toward the sixth process station VI.

The bottom forming portion 14 folded at the fifth process station V is guided to the sixth process station VI by contact with the folding rail 36, and the bottom forming portion 14 is folded to a greater extent by this movement.

The embodiment described can be modified variously as will be described below.

First, the bottom portion can be folded by any method insofar as the second and fourth bottom panels are initially folded in two into triangles and the first and third bottom panels are folded subsequent to the second and fourth bottom panels. According to the foregoing embodiment, the first and third bottom panels are folded by the second folding means, with the result that the outer edge portion of the first bottom panel is inserted between the outer edge portion of the third bottom panel and the triangular portions of the second and fourth bottom panels. Alternatively, the bottom portion can be folded, for example, in the same manner as is the case with the container disclosed in JP-Y No. 6-46669 and already described with reference to the prior art. Thus, an outer edge portion of the first bottom panel is lapped over triangular portions of the second and fourth bottom panels integral therewith, then folded over and tucked by folding under an outer edge portion of the third bottom panel and triangular portions of the second and fourth bottom panels integral therewith.

The first bottom panel has an ear upwardly projecting from the center of outer edge thereof, whereas the ear need not be formed as a distinct projection; the panel may have edges extending from opposite ends of outer edge of the ear to opposite ends of the panel outer edge, respectively.

Although the mandrels are arranged radially around a horizontal axis of rotation, also known is a packaging machine wherein a plurality of mandrels are provided as suspended from the peripheral edge of a horizontal rotary plate having a vertical axis of rotation (see JP-A No. 61-127403). The present invention is applicable also to such packaging machines.

Further alternatively, an endless track member movable in a vertical plane in circulation may be provided with a plurality of mandrels extending outward from the track member perpendicular thereto.

Although the first folding arms, as well as the second folding arms, are provided in a pair and closable toward each other for folding operation, a first folding arm or first folding arms may be made linearly movable axially of the mandrel toward or away from the end face of the mandrel instead of the closing movement.

What is claimed is:

1. A packaging machine comprising:

a movable body having mandrels, and drive means to intermittently drive said body so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, a bottom breaker for forming folds in a bottom forming end portion of the container fitted around the mandrel as halted at the process station so as to render the end portion foldable flat, and the bottom breaker having first folding means and second folding means, the first folding means being operable to fold the second and fourth bottom panels in two into triangles first, the second folding means being operable to fold first and third bottom panels subsequent to the second and fourth bottom panels, wherein the second folding means has an upstream arm and a downstream arm each being pivotally movable toward and away from the other about an axis extending transversely of the direction of movement of the mandrel, the upstream arm being movable into pressing contact with the first bottom panel for folding, the downstream arm being movable into pressing contact with the third bottom panel for folding, the downstream arm being provided at a portion thereof to be contacted with the third bottom panel with a pressure roller having an axis of rotation extending transversely of the direction of movement of the mandrel, and wherein the upstream arm is provided at a portion thereof to be contacted with the first bottom panel with a pressure roller having an axis of rotation extending transversely of the direction of movement of the mandrel.

2. A packaging machine according to claim 1, wherein the pressure roller on the upstream arm is of a diameter smaller than the diameter of the pressure roller on the downstream arm for controlling the speed and distance of relative movement of the pressure rollers toward each other.

3. A package machine comprising:

a movable body having mandrels, and drive means to intermittently drive said body so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, a bottom breaker for forming folds in a bottom forming end portion of the container fitted around the mandrel as halted at the process station so as to render the end portion foldable flat, the bottom breaker having first folding means and second folding means, the first folding means being operable to fold the second and fourth bottom panels in two into triangles first, the second folding means being operable to fold first and third bottom panels subsequent to the second and fourth bottom panels, wherein the second folding means has an upstream arm and a downstream arm each being pivotally movable toward and away from the other about an axis extending transversely of the direction of movement of the mandrel, the upstream arm being movable into pressing contact with the first bottom panel for folding, the downstream arm being movable into pressing contact with the third bottom panel for folding, the downstream arm being provided at a portion thereof to be contacted with the third bottom panel with a pressure roller having an axis of rotation extending transversely of the direction of movement of the mandrel, and wherein the upstream arm and the downstream arm are mounted respectively on a pair of pivots extending in parallel to each other and including means for adjusting the angle of pivotal movement of each of said arms.

4. A packaging machine according to claim 3, wherein the upstream arm is longer than the downstream arm for controlling a sequence of folding of container bottom panels.

5. A packaging machine according to claim 4, wherein the pressure roller on the upstream arm is of a diameter smaller than the diameter of the pressure roller on the downstream arm for controlling the speed and distance of relative movement of the pressure rollers toward each other.

6. A packaging machine comprising:

a movable body having mandrels, and drive means to intermittently drive said body so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, a bottom breaker for forming folds in a bottom forming end portion of the container fitted around the mandrel as halted at the process station so as to render the end portion foldable flat, the bottom breaker having first folding means and second folding means, the first folding means being operable to fold the second and fourth bottom panels in two into triangles first, the second folding means being operable to fold first and third bottom panels subsequent to the second and fourth bottom panels, wherein the second folding means has an upstream arm and a downstream arm each being pivotally movable toward and away from the other about an axis extending transversely of the direction of movement of the mandrel, the upstream arm being movable into pressing contact with the first bottom panel for folding, the downstream arm being movable into pressing contact with the third bottom panel for folding, the downstream arm being provided at a portion thereof to be contacted with the third bottom panel with a pressure roller having an axis of rotation extending transversely of the direction of movement of the mandrel, and wherein a folding rail is disposed so as to guide the bottom forming portion of the container as fitted around the mandrel moving from the process station while folding the bottom forming portion flat by contract therewith, the mandrel being movable with the pressure roller of the downstream arm in contact with the third bottom panel, and the third bottom panel of the container, as fitted around the mandrel being moved, is brought into contact with the folding rail while the third bottom panel is held in contact with the pressure roller.

7. A packaging machine comprising:

a movable body having mandrels, and drive means to intermittently drive said body so as to stop each of the mandrels at a process station while carrying containers as fitted around the respective mandrels with a bottom forming portion of each container projecting outward from the mandrel, the bottom forming portion having first to fourth bottom panels facing toward the upstream side with respect to the direction of movement of the mandrel, rightward, downstream side with respect to the direction of movement of the mandrel and leftward, respectively, a bottom breaker for forming folds in a bottom forming end portion of the container fitted around the mandrel as halted at the process station so as to render the end portion foldable flat, the bottom breaker having first folding means and second folding means, the first folding means being operable to fold the second and fourth bottom panels in two into triangles first, the second folding means being operable to fold first and third bottom panels subsequent to the second and fourth bottom panels, wherein the second folding means has an upstream arm and a downstream arm each being pivotally movable toward and away from the other about an axis extending transversely of the direction of movement of the mandrel, the upstream arm being movable into pressing contact with the first bottom panel for folding, the downstream arm being movable into pressing contact with the third bottom panel for folding, the downstream arm being provided at a portion thereof to be contacted with the third bottom panel with a pressure roller having an axis of rotation extending transversely of the direction of movement of the mandrel, and wherein the first folding means and the second folding means are driven individually by respective actuators.

* * * * *